US006381752B1

(12) United States Patent
Cartelli

(10) Patent No.: US 6,381,752 B1
(45) Date of Patent: May 7, 2002

(54) BRA WITH SELECTIVELY CONFIGURABLE STRAPS USING A STIFFENING ATTACHMENT

(76) Inventor: Kimberlynn Kren Cartelli, 34521 Via Espinoza, #B, Capistrano Beach, CA (US) 92624

( * ) Notice: Subject to any disclaimer, the term of this patent is extended or adjusted under 35 U.S.C. 154(b) by 0 days.

(21) Appl. No.: 09/990,245

(22) Filed: Nov. 20, 2001

(51) Int. Cl.[7] ..... A41C 3/00
(52) U.S. Cl. ..... 2/86; 2/88
(58) Field of Search ..... 450/36, 37, 38, 450/40, 41, 47, 80, 86, 87, 88; 2/311, 312, 326, 338, 336, 300, 304, 305, 308, 310, 321, 330, 155; 24/545, 302, 198, 199, 336, 563, 312, 313, 310

(56) References Cited

U.S. PATENT DOCUMENTS

| | | | | | |
|---|---|---|---|---|---|
| 1,478,773 | A | * | 12/1923 | Stocker | 450/86 |
| 1,804,855 | A | | 5/1931 | Bollwine | |
| 2,123,984 | A | * | 7/1938 | Baer | 2/326 |
| 2,649,639 | A | * | 8/1953 | Carlin | 450/86 |
| 4,276,884 | A | * | 7/1981 | O'Daniels | 450/86 |
| 4,481,682 | A | * | 11/1984 | Hall | 2/326 |
| 4,612,935 | A | | 9/1986 | Greifer | |
| 4,858,249 | A | * | 8/1989 | Stewart | 2/326 |
| 5,024,628 | A | | 6/1991 | Sanchez | |
| 5,935,044 | A | | 8/1999 | Brewster | |
| 5,964,642 | A | | 10/1999 | Fildan | |
| 6,135,853 | A | | 10/2000 | Hopson | |

FOREIGN PATENT DOCUMENTS

| | | |
|---|---|---|
| WO | WO88/05636 | 8/1988 |

* cited by examiner

*Primary Examiner*—Gloria M. Hale
(74) *Attorney, Agent, or Firm*—Gene Scott-Patent Law & Venture Group

(57) ABSTRACT

A brassierestrap adjustment system comprises a brassiere having a pair of horizontally spaced apart shoulder straps, the straps each having a series of vertically spaced apart apertures or loops where each of the apertures or loops in one of the straps forming a horizontally displaced pair of apertures or loops with a corresponding one of the apertures or loops of the other of the straps. A clasp is enabled for snap-action fastening through a selected pair of the holes or loops, or may be constructed as a simple link with opposing hook ends for grasping the loops. In this way, the straps may be drawn into an "X" shape for improved fit and concealment of the straps under an outer garment.

4 Claims, 2 Drawing Sheets

BRA WITH SELECTIVELY CONFIGURABLE STRAPS USING A STIFFENING ATTACHMENT

BACKGROUND OF THE INVENTION

1. Field of the Invention

This invention relates generally to wearing apparel especially underwear, and more particularly to devices interactively used with a brassiere to provide configurability to the straps for concealment and with comfort.

2. Description of Related Art

The following art defines the present state of this field:

Bollwine, U.S. Pat. No. 1,804,855 describes a brassiere comprising a pair of breast pockets, a connecting web of fabric between the pockets and joining the same together in relatively spaced relation, a triangular shaped fabric extension secured at its base portion of the outer side of each pocket, shoulder straps respectively secured at one end to a pocket and at the other end to the apex of one of the triangular extensions, a waist band co-extensive with the said web and triangular extension, and secured adjacent the lower longitudinal edges thereof with its opposite ends tapered to conform with and merge into the taper of the said triangular extensions, and an elastic strap permanently connected to the apex of one triangular extension and having separable connection with the apex of the other triangular extension.

Greifer, U.S. Pat. No. 4,612,935 describes comfort accessories for use with a conventional brassiere having a pair of shoulder straps. The accessories comprise shoulder strap adjusting means as well as shoulder strap pressure diffusing means. The shoulder strap adjusting means is arranged to adjust the position of at least one of the shoulder straps with respect to the wearer's shoulders and comprises an elongated flexible strip having loop means located at each end. Each loop means is arranged to extend and hold a portion of at least one of the shoulder straps so that the position of the shoulder strap is adjusted with respect to the shoulder. The pressure diffusing means is arranged to spread pressure applied by the shoulder strap across the wearer's shoulder and comprises pad means which are releasably secured by fastening means to one of the shoulder straps. The pad means is interposed between shoulder strap and the shoulder of the wearer.

Sanchez, U.S. Pat. No. 5,024,628 describes a maternity and nursing bra incorporating a one-handed fastening method that inherently allows for a stronger cup support and variable adjustment of cup size. It is accomplished by affixing parts of a fastener to the inside of an inner cup to an inner band. Also incorporated into the inside of the inner cup is an optional use nursing pad pocket. The bra's variable strap width adjusting band and the relocatable shoulder straps enables the bra to be worn with a variety of outer garment styles.

Brewster, U.S. Pat. No. 5,935,044 describes a method and apparatus for securing brassiere straps in a selected position preventing the straps from sliding off the shoulders of the user.

Fildan, U.S. Pat. No. 5,964,642 describes a shoulder strap connector for a garment having a first oval or circular member connected to one of the shoulder straps and a second oval or circular member connected to the other shoulder strap and provided with a hook engaging the first member so that the straps can be joined in an X pattern when desired. The hook projects inwardly substantially to an extension of the inner periphery of the second member and in any event lies inwardly of an extension of the outer periphery of the inner member.

Hopson, U.S. Pat. No. 6,135,853 describes an apparatus for concealing bra straps. The bra strap concealer being formed by a plurality of elastic members coupled to portions of the bra. Various clasping mechanisms are also disclosed.

Reaver, U.S. WO 88/05636 describes a fastener device attached to the shoulder strap of a foundation garment, such as a brassiere, for securing the undersurface of an overlying outer garment worn over the shoulder strap to conceal the shoulder strap from view.

Depending on the cut of a blouse or a shirt, it is desirable to wear a brassiere that is able to hide its straps under the garment. This usually requires at least two different brassieres, one with shoulder straps separated for a low cut back panel of the garment, and another for severely cut shoulder panels. Another problem is that when straps are linked together, and pulled into an offset position they tend to curl and pull away from the skin surface becoming more noticeable. The prior art teaches the use of articles for adjusting the lay of brassiere straps but does not teach a selectively adjustable system that will not move under the stress resulting from the wearer's movements, and is stiff enough to prevent fabric brassiere straps from curling and pulling away from a skin surface and is wholly comfortable to the wearer because it uses an attachment link that has a stiff enough to constrain the curling tendency of straps, yet has a flexible core covered by a fabric for comfort. The present invention fulfills these needs and provides further related advantages as described in the following summary.

SUMMARY OF THE INVENTION

The present invention teaches certain benefits in construction and use which give rise to the objectives described below.

The present invention provides a means for selectively adjusting the straps to fit the outer garment, and in a manner where the straps will not move apart or closer together or change their configuration during wear. The present invention brassiere strap adjustment system comprises a brassiere having a pair of horizontally spaced apart shoulder straps as is commonly used for support and comfort, the straps each having a series of vertically spaced apart apertures or loops. A clasp is enabled for fastening through a selected pair of the holes or loops. In this way, the straps may be drawn into an "X" shape for improved fit and concealment of the straps under an outer garment whether the garment has a severely cut back or arm panels. Because the attachments, are fixed in one place they cannot move or readjust themselves during wear. The present invention distinguishes over the prior art in providing discrete positions where the bra straps may be engaged so that the straps are held securely as set until released. It should be noted that in Greifer U.S. Pat. No. 4,612,935, Hopson U.S. Pat. No. 6,135,853, Brewster U.S. Pat. No. 5,935,044, Fildan U.S. Pat. No. 5,964,642 teach solutions to the present issue wherein the cross link is able to move during wear, especially during severe activity. Reaver PCT, teaches the attachment of an outer garment to a brassiere strap. Bollwine U.S. Pat. No. 1,804,855 teaches a cross link that is fixed at one position and is not selectively placed. Sanchez U.S. Pat. No. 5,024,628 teaches a selectively positionable link but does not teach the constructional features of the present invention which adds further benefits in fit and form during wear. The present novel solutions are inexpensive, easy to apply, prevent strap curling and are comfortable to wear.

A primary objective of the present invention is to provide an apparatus and method of use of such apparatus that provides advantages not taught by the prior art.

Another objective is to provide such an invention capable of adjusting a pair of shoulder straps of a brassiere in accordance with fit, comfort and concealment needs.

A further objective is to provide such an invention capable of secure attachment so that the shoulder straps cannot move or curl and pull away from the skin surface during wear.

A still further objective is to provide such an invention capable of maintaining the form of the brassiere straps although subject to high tension.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
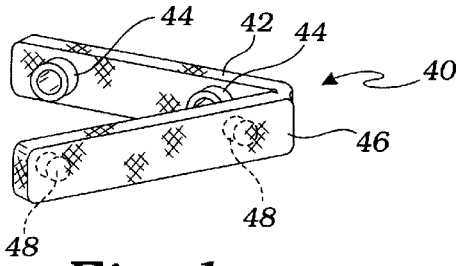
FIG. 1 is a perspective view of a preferred embodiment of a clasp of the present invention.
Figure 2:
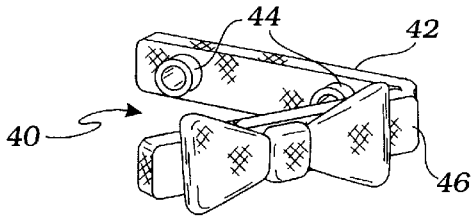
FIG. 2 is a perspective view thereof wherein a decorative element is added.
Figure 3:
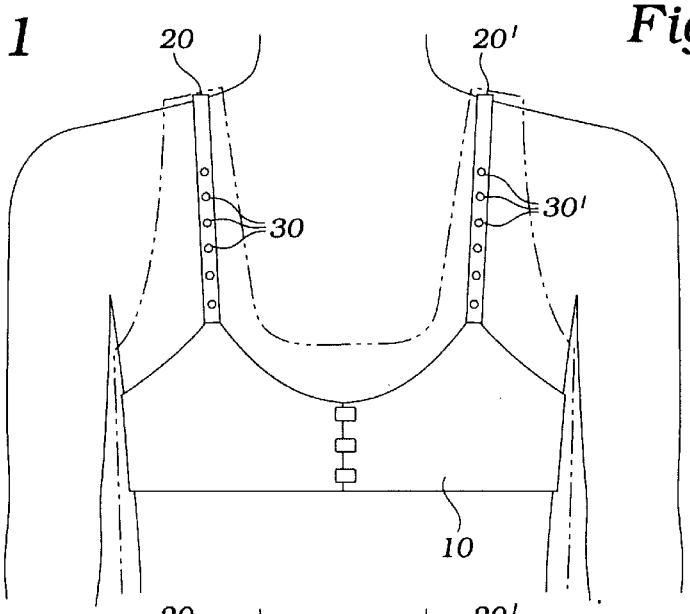
FIG. 3 is an elevational rear view of a first preferred embodiment of a brassiere of the present invention showing straps with apertures.
Figure 4:
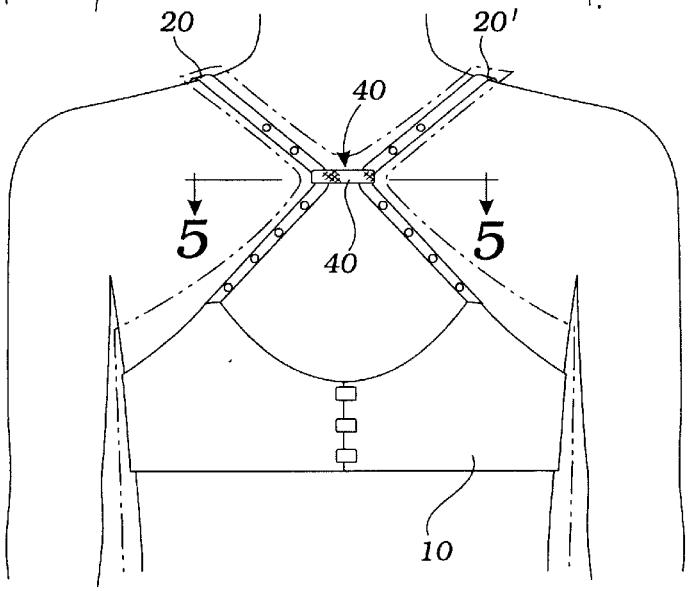
FIG. 4 is an elevational view thereof with the clasp of FIG. 1 shown in combination.

The present invention, in a first embodiment, is a brassiere strap adjustment system comprising in combination, a brassiere 10 having a pair of horizontally spaced apart shoulder straps 20 and 20', the straps each having a series of vertically spaced apart apertures 30 and 30' respectively, therein. Each of the apertures 30 in one of the straps 20 forms a horizontally displaced pair of apertures 30, 30' with a corresponding one of the apertures 30' of the other of the straps 20'. A clasp 40 comprises a first portion 42 providing a pair of spaced apart first fastening means 44, and a second portion 46 providing a pair of spaced apart second fastening means 48. The first and second fastening means 44 and 48 are adapted by their conformation, for mutual engagement through a selected one of the pairs of apertures 30, 30' when the pairs of apertures are brought into mutual alignment with the first and second fastening means for drawing the straps into an "X" shape, FIG. 4, for improved fit and concealment of the straps 20, 20' under an outer garment. This is clearly shown in FIG. 4 where the outline of the garment is shown in phantom lines.

Preferably, the first and second portions 42, 46 of the clasp 40 are made of sheet plastic and the first and second fastening means 44, 48 are enabled for being joined by a snap action between the first and second fastening means. Such snap action fasteners are well known in the art, so that further discussion is not present.

Figure 6:
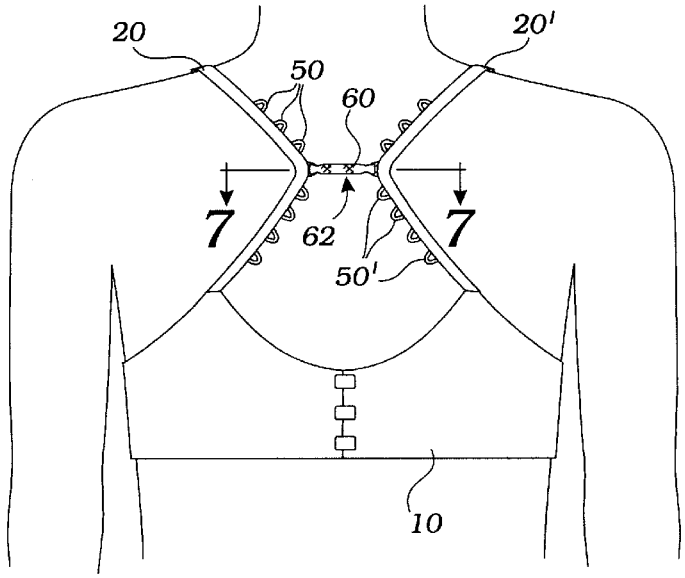
FIG. 6 is an elevational rear view of a second preferred embodiment of a brassiere of the present invention showing straps with loops joined by a link of the invention.
Figure 7:
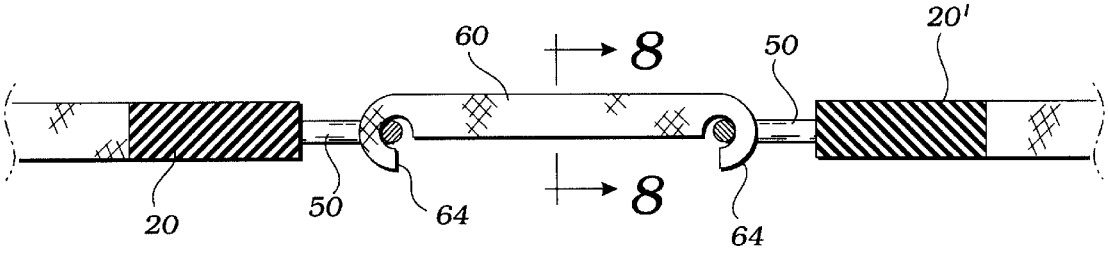
FIG. 7 is a sectional view taken along line 7—7 in FIG. 6.

In an alternate second embodiment shown in FIG. 6, the apertures are replaced by loops, 50 and 50'. In this embodiment, the loops may be simple threaded loops or may be plastic loops sewn to the straps 20, 20'. The clasp used in this embodiment may be the same clasp 40 used, as described above. Alternately, a different clasp 60 may comprise an elongate body providing a pair of terminal ends 62, 62' in mutual opposition. Each of the ends may be formed as a hook in shape as shown in FIG. 7. This clasp 60 engages a selected one of the pairs of the loops for drawing the straps into an "X" shape for improved fit and concealment of the straps under an outer garment as shown in FIG. 6.

Figure 8:
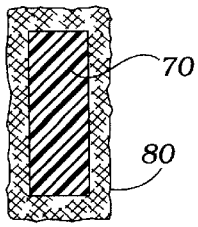
FIG. 8 is a sectional view taken along line 8—8 in FIG. 7.

In further describing the present invention it may be seen that the shoulder straps, have a series of horizontally aligned pairs of vertically spaced apart first engagement elements; holes 30, loops 50, etc and a clasp 40 or 60 comprising a linking means portion 62 or 42 and 46, with opposing terminal-end second engagement elements 64 or 44 and 48 adapted for engaging one of the pairs of first engagement elements, for drawing the straps into an "X" shape for improved fit and concealment of the straps 20, 20' under an outer garment where the linking portion comprises a stiff but flexible core 70 covered by a fabric exterior 80 as shown in FIG. 8.

Figure 5:
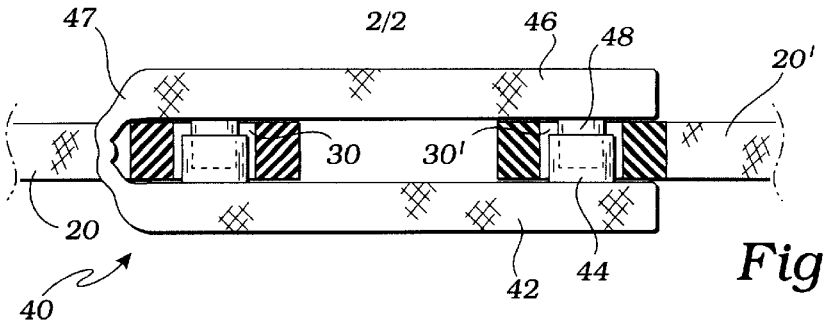
FIG. 5 is a sectional view taken along line 5—5 in FIG. 4.

As seen in FIG. 5, the linking means comprises a pair of spaced apart sheet struts 342, 46 joined by a hinge 47 at one end of each of the struts and the second engagement element is dual, spaced-apart mutually engaging snap-fasteners each identified by 44, 48.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A brassierestrap adjustment system comprising in combination: a brassiere having a pair of horizontally spaced apart shoulder straps, the straps having a series of horizontally aligned pairs of vertically spaced apart first engagement elements; and a clasp comprising a linking means portion with opposing terminal-end second engagement elements adapted for engaging one of the pairs of first engagement elements, for drawing the straps into an "X" shape for improved fit and concealment of the straps under an outer garment; the linking portion comprising a stiff but flexible core covered by a fabric exterior.

2. The system of claim 1 wherein the linking means comprises a pair of spaced apart sheet struts joined by a hinge at one end of each of the struts and the second engagement element is dual, spaced-apart mutually engaging snap-fasteners.

3. The system of claim 2 wherein each of the struts is made of sheet plastic.

4. The system of claim 1 wherein the linking means comprises a single strut made of a sheet plastic and the second engagement elements are hooks.

* * * * *